US007097049B1

(12) United States Patent
Singer et al.

(10) Patent No.: US 7,097,049 B1
(45) Date of Patent: Aug. 29, 2006

(54) WINDOW TREATMENT SWATCH CARD SAMPLING DISPLAY AND SWATCH CARDS THEREFOR

(75) Inventors: James Singer, Sarasota, FL (US); Mike Kollman, Madison, WI (US)

(73) Assignee: Vista Products, Inc., Sarasota, FL (US)

( * ) Notice: Subject to any disclaimer, the term of this patent is extended or adjusted under 35 U.S.C. 154(b) by 371 days.

(21) Appl. No.: 10/819,504

(22) Filed: Apr. 6, 2004

(51) Int. Cl.
*A47F 7/14* (2006.01)

(52) U.S. Cl. ..... 211/55

(58) Field of Classification Search ..... 211/55, 211/52, 13.1, 45, 128.1; 434/367; 40/124.06, 40/124.2

See application file for complete search history.

(56) References Cited

U.S. PATENT DOCUMENTS

| | | | | |
|---|---|---|---|---|
| 886,057 | A | 4/1908 | Hockaday | |
| 1,045,372 | A | 11/1912 | Cohen | |
| 2,795,059 | A | 6/1957 | Mendelsohn | |
| 3,430,364 | A | 3/1969 | Kirschbaum | |
| 4,253,259 | A | 3/1981 | Schaffer | |
| D278,954 | S * | 5/1985 | Bolyn | D6/409 |
| D303,460 | S | 9/1989 | Schouten | |
| 5,050,747 | A * | 9/1991 | Krautsack | 211/50 |
| D335,781 | S | 5/1993 | Moncrief | |
| 5,228,857 | A | 7/1993 | Roland | |
| 5,370,024 | A | 12/1994 | Lerner | |
| 5,720,396 | A * | 2/1998 | Wegscheid et al. | 211/55 |
| 5,758,781 | A * | 6/1998 | Lord et al. | 211/55 |
| 5,807,110 | A | 9/1998 | Hytry | |
| 5,855,480 | A | 1/1999 | Housman | |
| 6,039,576 | A | 3/2000 | Gabig | |
| 6,068,139 | A | 5/2000 | Brozak | |
| 6,527,128 | B1 | 3/2003 | Samaria | |

* cited by examiner

*Primary Examiner*—Sarah Purol
(74) *Attorney, Agent, or Firm*—Charles J. Prescott

(57) ABSTRACT

A window treatment swatch card and a swatch card display for displaying a plurality of groups of swatch cards. Each swatch card has an actual sample of window treatment material and indicia identifying information associated with the particular window treatment material attached on a first portion thereof. Each swatch card within each group is provided with indicia identifying information associated with the corresponding sample on a second portion thereof. The display unit includes a plurality of columns of pockets, each of which is closely sized for one group of said swatch cards to be removably stored therein in an upright fashion. The swatch cards, having a height slightly greater than that of each pocket, permit each different sample to be viewed before being removed from the pocket and taken home and kept by the consumer.

27 Claims, 9 Drawing Sheets

| | 18 | 24 | 30 | 36 | 42 | 48 | 54 | 60 | 66 | 72 |
|---|---|---|---|---|---|---|---|---|---|---|
| 30 | 36 | 45 | 53 | 60 | 70 | 78 | 87 | 95 | 103 | 111 |
| 36 | 40 | 50 | 59 | 68 | 78 | 87 | 97 | 106 | 116 | 125 |
| 42 | 43 | 54 | 63 | 73 | 85 | 95 | 106 | 116 | 127 | 137 |
| 48 | 46 | 59 | 70 | 80 | 93 | 105 | 117 | 128 | 140 | 151 |
| 54 | 49 | 63 | 74 | 86 | 100 | 113 | 126 | 138 | 151 | 163 |
| 60 | 53 | 67 | 80 | 93 | 109 | 122 | 136 | 150 | 164 | 177 |
| 66 | 56 | 71 | 85 | 99 | 116 | 130 | 145 | 159 | 174 | 189 |
| 72 | 59 | 76 | 91 | 106 | 124 | 139 | 156 | 171 | 188 | 203 |
| 78 | 62 | 80 | 96 | 112 | 131 | 147 | 165 | 181 | 198 | 215 |
| Crown | 5 | 5 | 8 | 8 | 10 | 10 | 13 | 13 | 15 | 15 |

FIG. 15

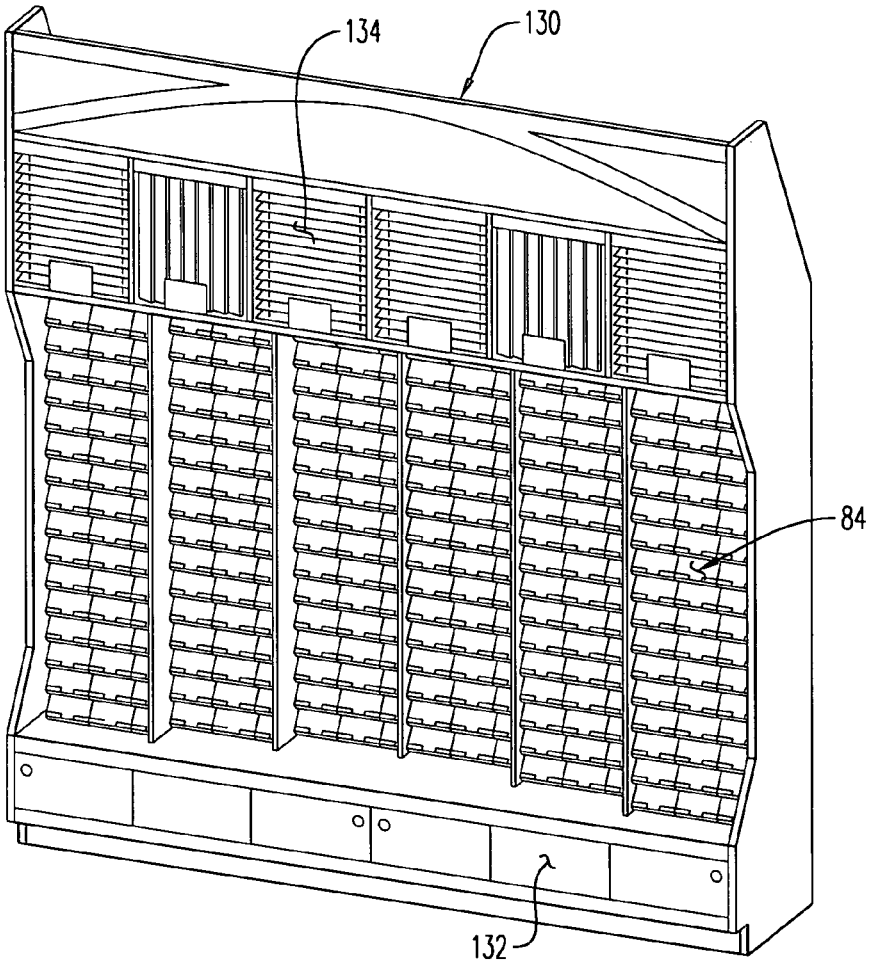

FIG. 16

140

$ PRICE $

| Height in Inches To: | Width in Inches To: 18 | 24 | 30 | 36 | 42 | 48 | 54 | 60 | 66 | 72 | 84 | 96 |
|---|---|---|---|---|---|---|---|---|---|---|---|---|
| 30 | 28 | 34 | 41 | 48 | 55 | 61 | 67 | 75 | 81 | 88 | 101 | 115 |
| 36 | 31 | 39 | 47 | 55 | 63 | 70 | 78 | 86 | 94 | 101 | 117 | 133 |
| 42 | 34 | 43 | 51 | 60 | 69 | 77 | 86 | 95 | 104 | 112 | 130 | 147 |
| 48 | 38 | 47 | 57 | 67 | 77 | 86 | 96 | 107 | 116 | 126 | 46 | 165 |
| 54 | 40 | 51 | 61 | 73 | 83 | 94 | 104 | 116 | 126 | 137 | 158 | 179 |
| 60 | 44 | 55 | 67 | 79 | 91 | 103 | 114 | 127 | 139 | 150 | 174 | 198 |
| 66 | 47 | 59 | 71 | 85 | 97 | 110 | 122 | 136 | 149 | 161 | 187 | 212 |
| 72 | 50 | 64 | 77 | 91 | 105 | 119 | 133 | 147 | 161 | 175 | 203 | 230 |
| 78 | 53 | 67 | 82 | 97 | 112 | 126 | 141 | 156 | 171 | 185 | | |
| 84 | 55 | 71 | 86 | 102 | 117 | 133 | 149 | 163 | 181 | 195 | | |
| 90 | 59 | 75 | 92 | 109 | 125 | 142 | 159 | 177 | 198 | | | |
| 96 | 61 | 79 | 96 | 115 | 132 | 150 | 167 | 186 | 203 | | | |

Find your window size on the chart above. That is the cost of your blind. If you want a Crown or Master Valance, refer to surcharge above and add that to the cost of your blind. Installation not included.

*Price Example: Your window is 35" wide x 47" high. Price as 36" wide x 48" high. Your cost is $67*

To Order:
- See store sales associate
- Call 1-800-xxx-xxxx
- Visit our web site at www.vistaproducts.com Vendor Number 861542931 Stock 100-151

INSTALLATION

Mounting Options ☐ Inside (Window Frame) ☐ Outside (Wall Mount)

FREE OPTIONS

Tilt Control ☐ Left ☐ Right ☐ Wand ☐ Cord

Lift Control ☐ Left ☐ Right

Hold Down Brackets ☐ Yes ☐ No

☐ Standard Valence

SURCHARGE OPTIONS

☐ Crown Valence (see chart)

☐ Master Valence (see chart)

☐ Twill Tapes (add 10%)

*If you want twill tapes, multiply the cost of your blind by 10% and add that to the cost of your blind.*

Limited Lifetime Warranty

WINDOW TREATMENT SWATCH CARD SAMPLING DISPLAY AND SWATCH CARDS THEREFOR

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to commercial retail display units and samples therefor, and more particularly to a display unit and swatch card for displaying a plurality of actual samples of window treatment materials.

2. Description of Related Art

Displaying of product samples for retail or wholesale is well known. An example of such a display unit is taught in U.S. Pat. No. 5,855,480 invented by Housman disclosing a wall covering sample card storage unit. A brick display board invented by Roland is also disclosed in U.S. Pat. No. 5,228,857 wherein, in one embodiment, display bricks are permanently attached to a Plexiglas sheet by adhesive.

Moncrief, et al. in U.S. Design 335,781 teaches a display unit for floor tile samples. Another design patent is disclosed for displaying flooring samples in U.S. Design 303,460 invented by Schouten.

Samaria, in U.S. Pat. No. 6,527,128 teaches a perpendicular display rack for pegboard support members. This invention includes a main frame capable of holding a package which might be a display card capable of holding product samples.

An older U.S. Pat. No. 3,430,364, teaches a fabric display device invented by Kirschbaum. Schaffer in U.S. Pat. No. 4,253,259 teaches a carpet display system in which colors of a particular line of carpeting are displayed on a single card.

The display unit for samples of floor tiles, carpets and similar articles invented by Bolyn is disclosed in U.S. Design 278,954. The advertising device invented by Cohen in U.S. Pat. No. 1,045,372 teaches the display of miniature rug samples on a larger wall surface.

A merchandising selling system and display unit therefor is taught by Gabig in U.S. Pat. No. 6,039,576 in which a product display board including samples of memorial products of each product line are arranged in rows with related design features arranged in the columns.

Other product sample methods now available include sample books which may not be taken home or kept by the consumer. Mail order companies will, upon request, send actual samples, but are not attached to sample cards that also show pricing and options.

The following additional U.S. patents are known to teach some form of commercial display of product as follows:

U.S. Pat. No. 5,807,110 to Hytry, et al.

U.S. Pat. No. 6,068,139 to Brozak, Jr.

U.S. Pat. No. 2,795,059 to Mendelsohn

U.S. Pat. No. 5,370,024 to Lerner, et al.

U.S. Pat. No. 886,057 to Hockaday

The present invention discloses a window treatment swatch card sampling display for actual take home swatch cards, each of which bear an actual sample of a window treatment material and indicia identifying information associated with that particular sample. The display unit is structured to hold and display columns of groups of actual samples so that a perspective purchaser of window treatment product may easily view samples available and then remove one or more of the swatch cards for closer examination at home, for example, to allow more careful comparison to the actual installation environment. Further product identification information applied thereto allows the consumer to carry the selected swatch cards home for close comparison to the window installation environment.

BRIEF SUMMARY OF THE INVENTION

This invention is directed to a window treatment swatch card and a swatch display unit for displaying the plurality of groups of swatch cards. Each swatch card has a particular sample of window treatment material and indicia identifying information associated with the particular window treatment material attached on a first portion thereof. Each swatch card within each group is provided with indicia identifying information associated with the corresponding sample on a second portion thereof. The display unit includes a plurality of columns of pockets, each of which is closely sized for one group of said swatch cards to be removably stored therein in an upright fashion. The swatch cards, having a height slightly greater than that of each pocket, permit each different sample to be viewed before being removed from the pocket.

It is therefore an object of this invention to provide swatch cards bearing actual particular samples of window treatment material and indicia identifying information associated with each particular sample which may be taken home and kept by the consumer.

Still another object of this invention is to provide, in combination, groups of individual window treatment swatch cards, each in the group bearing the same window treatment material and indicia identifying information and being viewably placeable into one pocket in a column of pockets of a display unit.

Yet another object of this invention is to provide window treatment swatch cards which bear the actual samples of window treatment material and product coloration for selection and removal from a display unit to be carried to a home or office environment for direct comparison in the environment in which the window treatment will be installed.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 15 is yet another pictorial perspective view of still another embodiment of a display unit including modules of columns of pockets containing groups of window treatment swatch cards held therein.

FIG. 16 is a rear elevation view of the reverse surface of another embodiment of the window treatment swatch card.

DETAILED DESCRIPTION OF THE INVENTION

Figure 1:
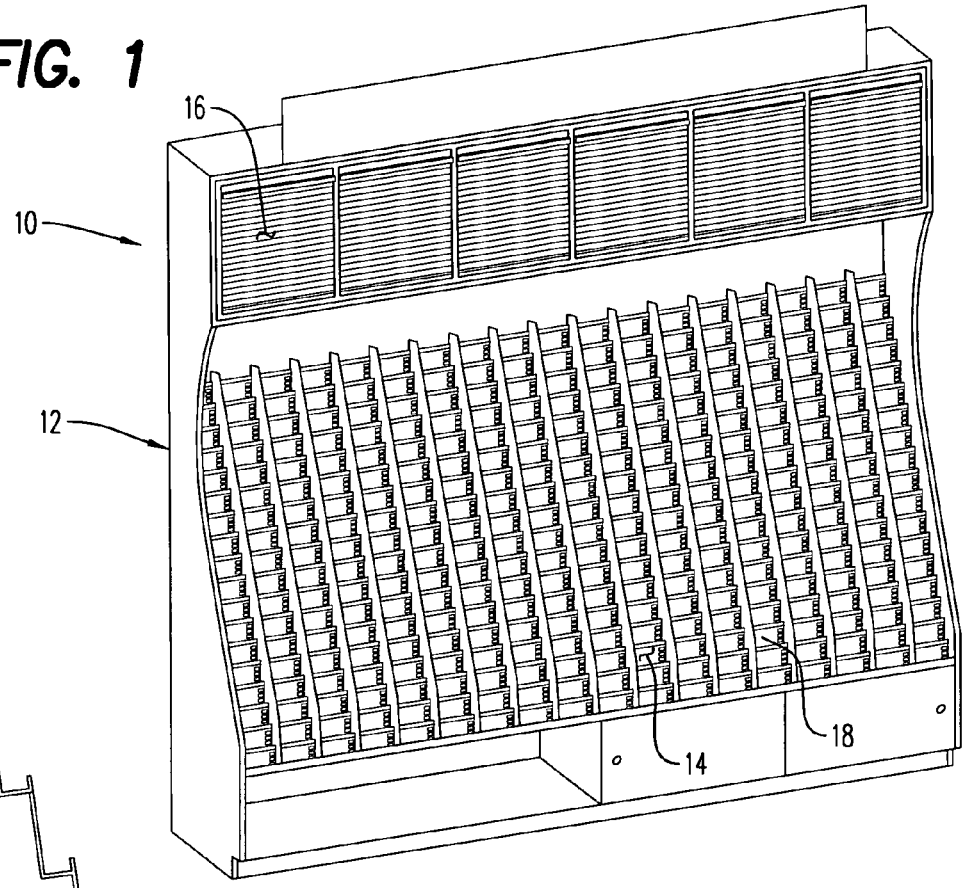
FIG. 1 is a perspective view of one embodiment of the display unit having columns of pockets bearing groups of window treatment swatch cards placed therein.
Figure 2:
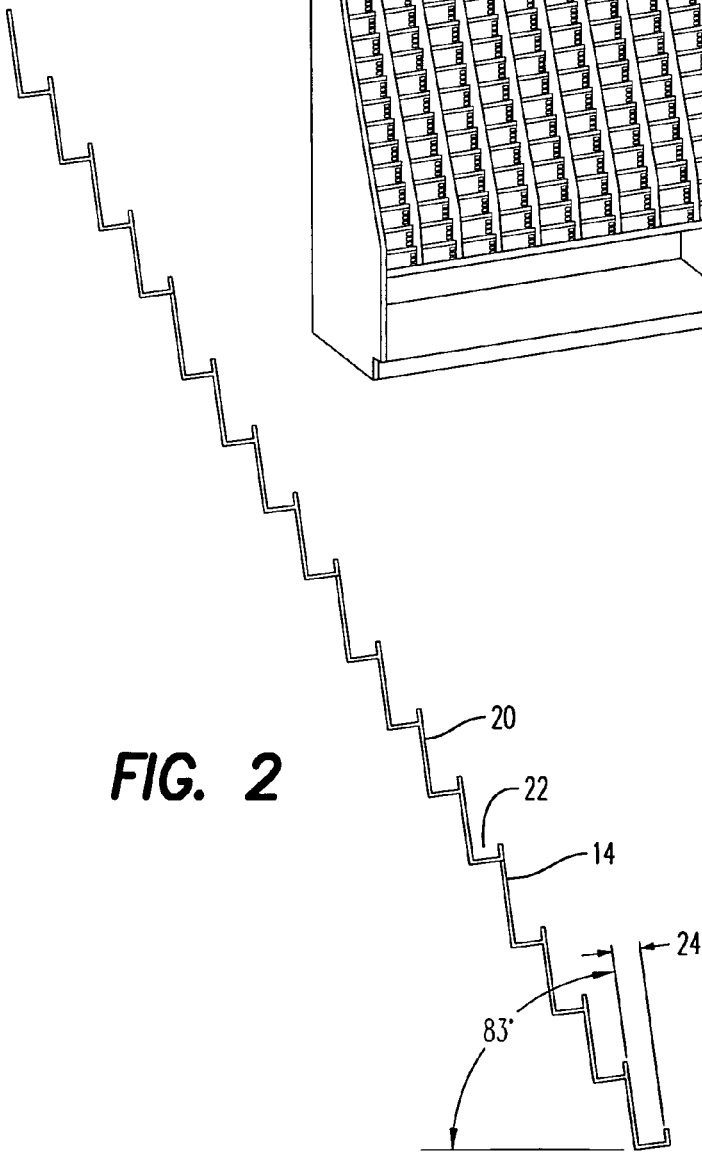
FIG. 2 is a simplified side elevation view of one of the columns of pockets of the display unit of FIG. 1.

Referring now to the drawings, and particularly to FIGS. 1 and 2, one embodiment of the invention is there shown generally at numeral 10 and includes a display unit 12 including a plurality of columns of pockets 14 each holding a group of window treatment swatch cards 18 which will be described in more detail herebelow. The display unit 12 also includes a plurality of actual operable sample blinds 16 which either forms or covers an openable door providing access to a storage bin therebehind. Additional storage bins for a supply of swatch cards are provided beneath the columns of pockets 14 as shown.

As seen in FIG. 2, each of the columns 14 of pockets 22 is formed of either metal or plastic thin wall material, preferably as a unit. The pockets 22 each have a generally upright back wall 20 which is inclined to horizontal preferably at an angle of about 83° or between an angle generally of 70° to 90° so as to maintain in each group of swatch cards 18 in a rearwardly leaned and stable orientation. The width 24 of each pocket 22 is sized to receive a preselected group or number of swatch cards 18 each bearing the same window treatment material and product identification information thereon.

Figure 3:
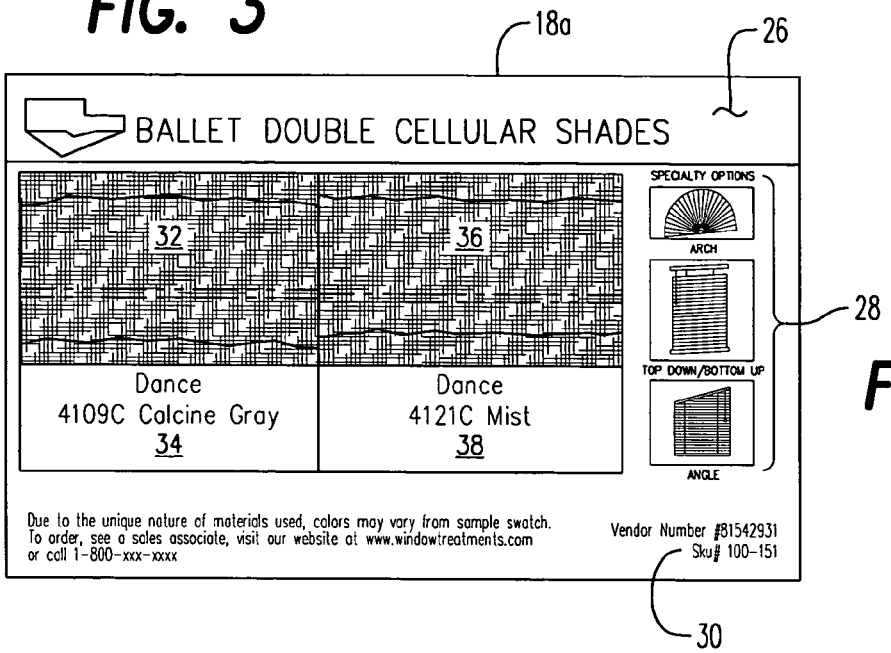
FIG. 3 is a front elevation view of an obverse surface of one embodiment of a window treatment swatch card.

Examples of swatch cards bearing various types of window treatment material are shown in FIGS. 3 to 9. In FIG. 3, a double cellular window shade is shown at 32 and 34. Each of the window treatment material samples 32 and 36 bear a product identification label 34 and 38 which is adhesively applied thereto. The swatch card 18*a* also includes the broad product category indicia 26 and specialty options 28 which typically show installation options for the particular window treatment material 32 and 36. Additionally, vendor information is applied to the card 18*a* at 30.

Figure 7:
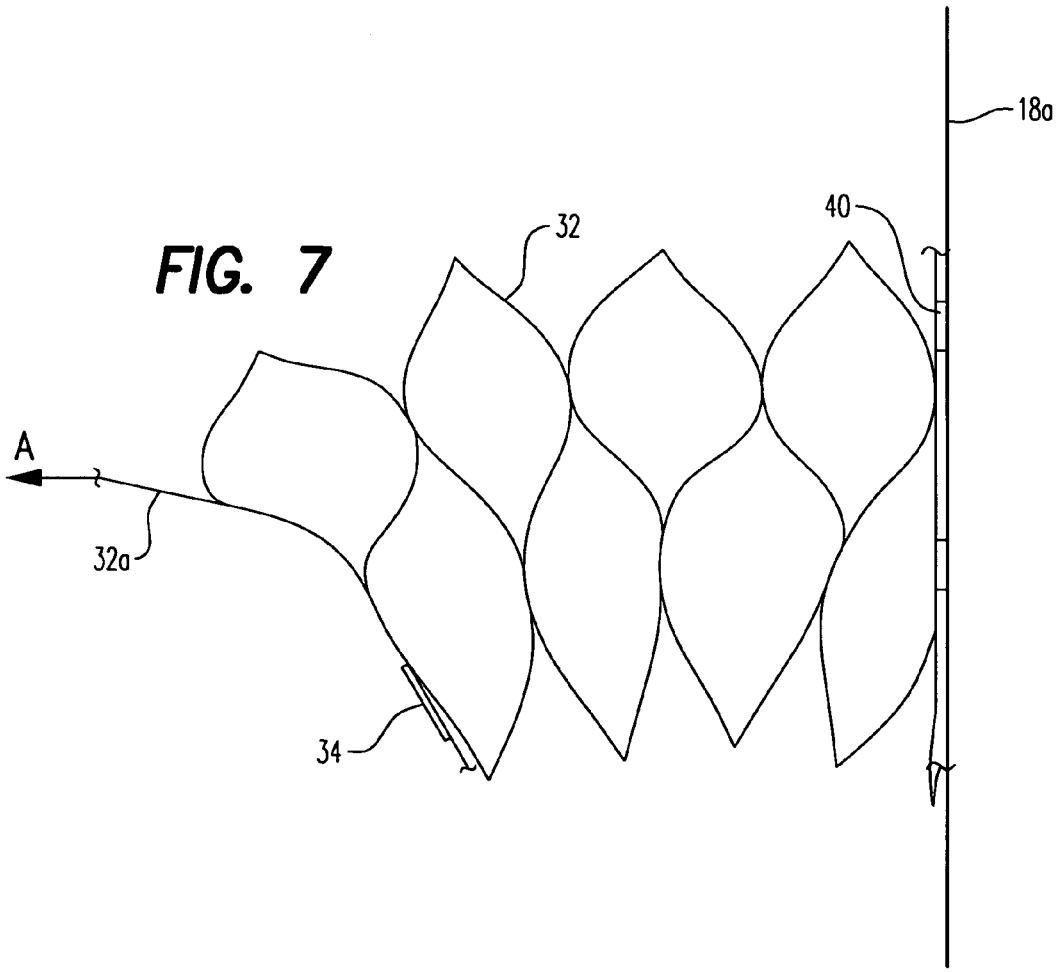
FIG. 7 is a side elevation view of the window treatment material of FIG. 3 shown in a normal expanded in-use orientation.

In this swatch card embodiment 18*a* as seen in FIG. 7, the outwardly exposed panel segment 32*a* of the double cellular shade sample 32 may be pulled in the direction of arrow A while holding the swatch card 18*a* itself so as to expand the sample 32 as shown. The concealed end of the sample segment 32 is adhesively attached at 40 to the swatch card 18*a* to both releasably retain this sample 32 and to facilitate its expanded viewing as shown.

Figure 4:
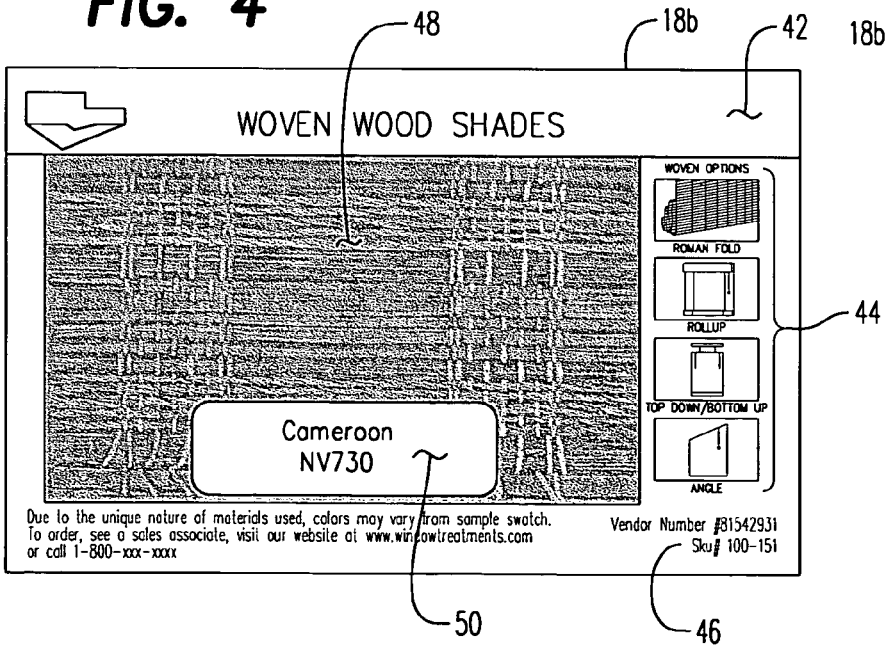
FIG. 4 is a front elevation view of the obverse surface of another window treatment swatch card.
Figure 5:
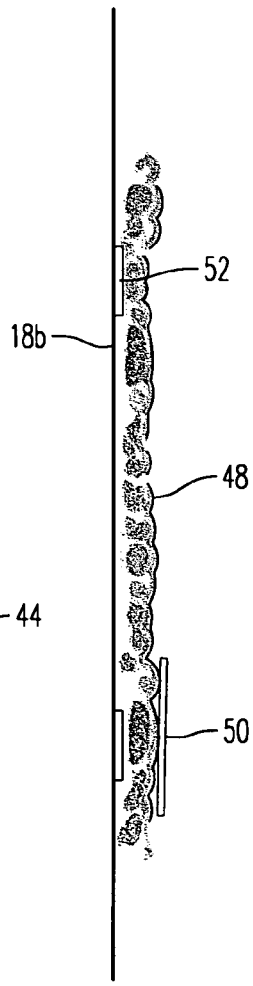
FIG. 5 is a vertical section view taken through the embodiment shown in FIG. 4.

Referring now to FIGS. 4 and 5, another embodiment of the swatch card is shown at 18*b*. This embodiment 18*b* includes a window treatment material 48 in the form of woven wood shades formed of lengths of slender actual wood material. The product identification is shown at 42 while woven options are shown at 44 and the vendor identification number being shown at 46. A specific product name and number is attached to the sample 48 by an adhesive label 50 as shown.

Figure 6:
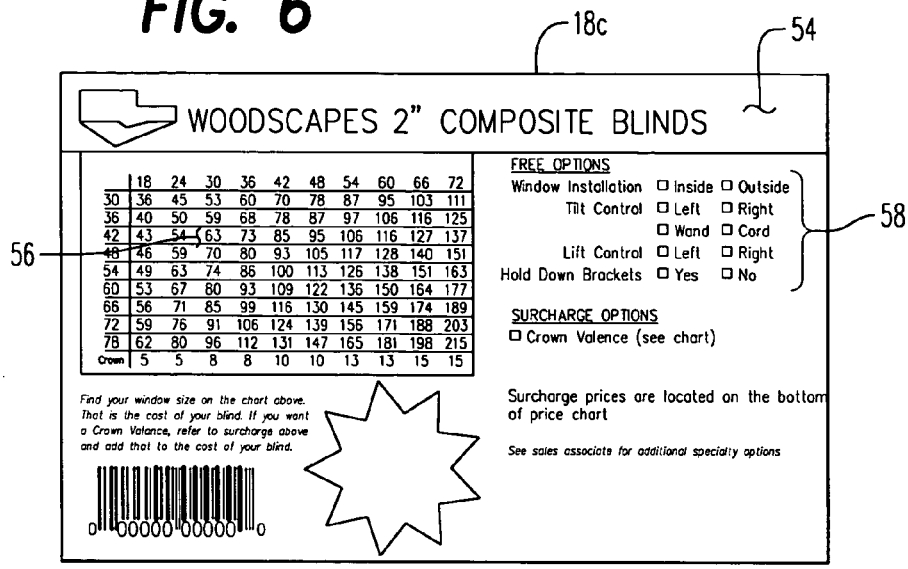
FIG. 6 is a rear elevation view of the reverse surface of a window treatment swatch card.

In FIG. 6, the reverse side of a typical swatch card 18*c* is there shown. This reverse surface typically includes the pricing of available sizes at 56 of each product, in this case, WOODSCAPES 2" composite blinds at 54. Also shown on this reverse surface is information at 58 related to the options for this particular sample at 54 which are free and those which are subject to a surcharge or an additional cost factor.

Figure 8:
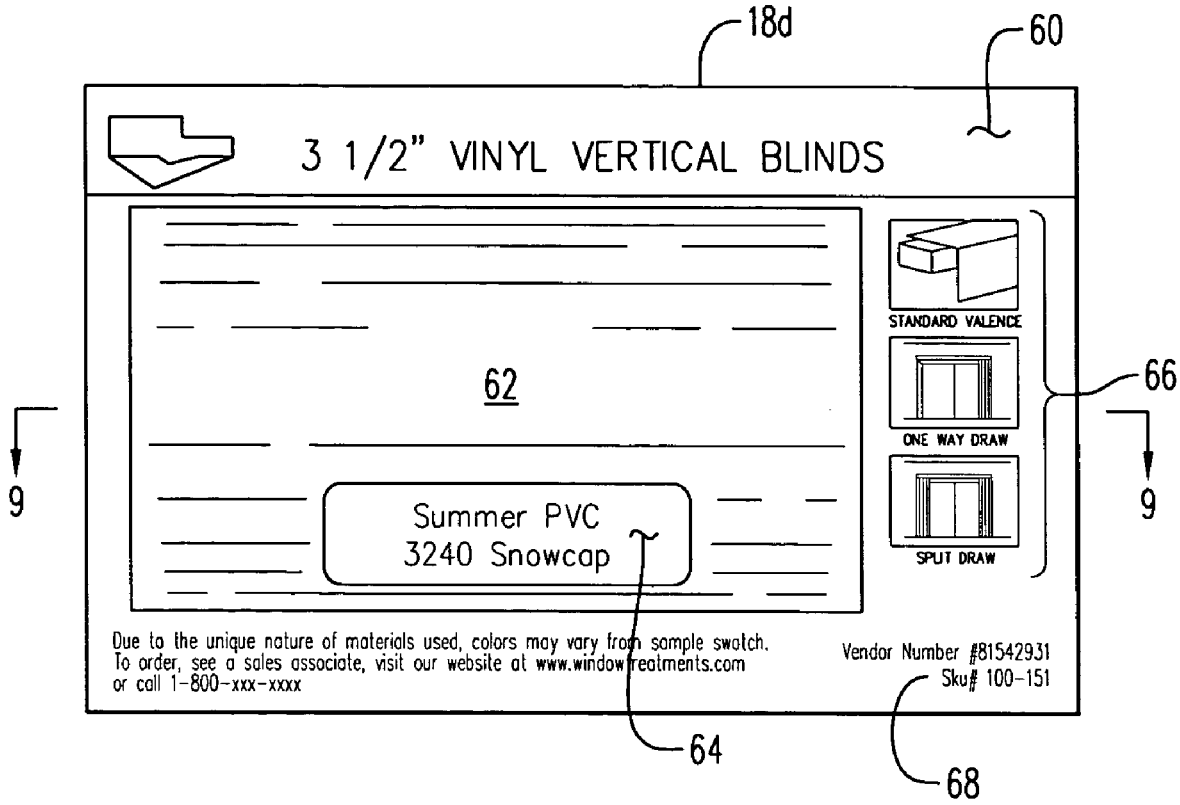
FIG. 8 is a front elevation view of still another embodiment of a window treatment swatch card.
Figure 9:
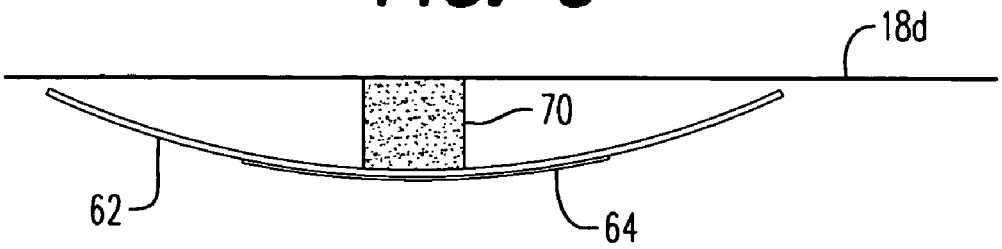
FIG. 9 is a top elevation view in the direction of arrows 9—9 in FIG. 8.

Referring now to FIGS. 8 and 9, still another embodiment of the swatch card is there shown at 18*d*. This swatch card 18*d*, entitled "3½" Vinyl Vertical Blinds" at 60 includes an actual segment of vertical blinds 62 which as seen in FIG. 9, is arcuate. To attach this window treatment material 62, a thick compressible double-sided adhesive member 70 is attached as shown between the swatch card 18*d* and the back surface of the sample 62. A specific product identification label 64 is adhesively attached to the outer surface of the sample 62 while installation options at 66 and vendor identification at 68 are also provided on that portion of the swatch card 18*d*.

The following window treatment materials are envisioned at this time:

3½" Vinyl Vertical Blinds
HAMPTON 2" Vinyl Blinds
Fabric Vertical Blinds
Pleated Shades
Single Cellular Shades
BALLET Double Cellular Shades
PANAMA 2 Faux Wood Blinds
Woven Wood Shades
"WOODSCAPES" 2" Composite Blinds
2" SOUTHWEST Wood Blinds
1" Aluminum Mini-Blinds Again, these are all segments of actual window treatment materials available in all available colors and textures.

Figure 10:
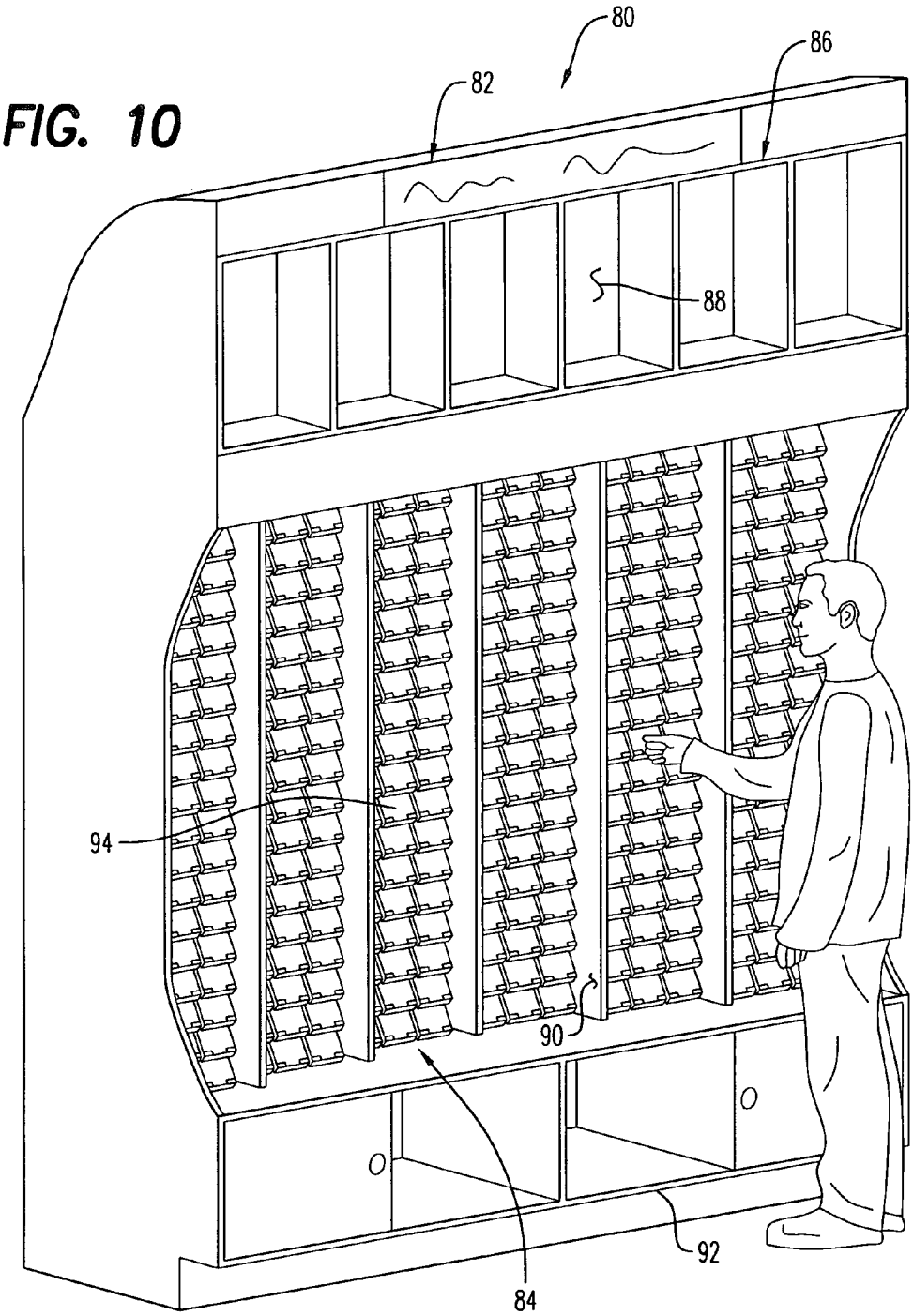
FIG. 10 is a pictorial perspective view of another embodiment of a display unit and modules of columns of pockets containing groups of window treatment swatch cards held therein.
Figure 11:
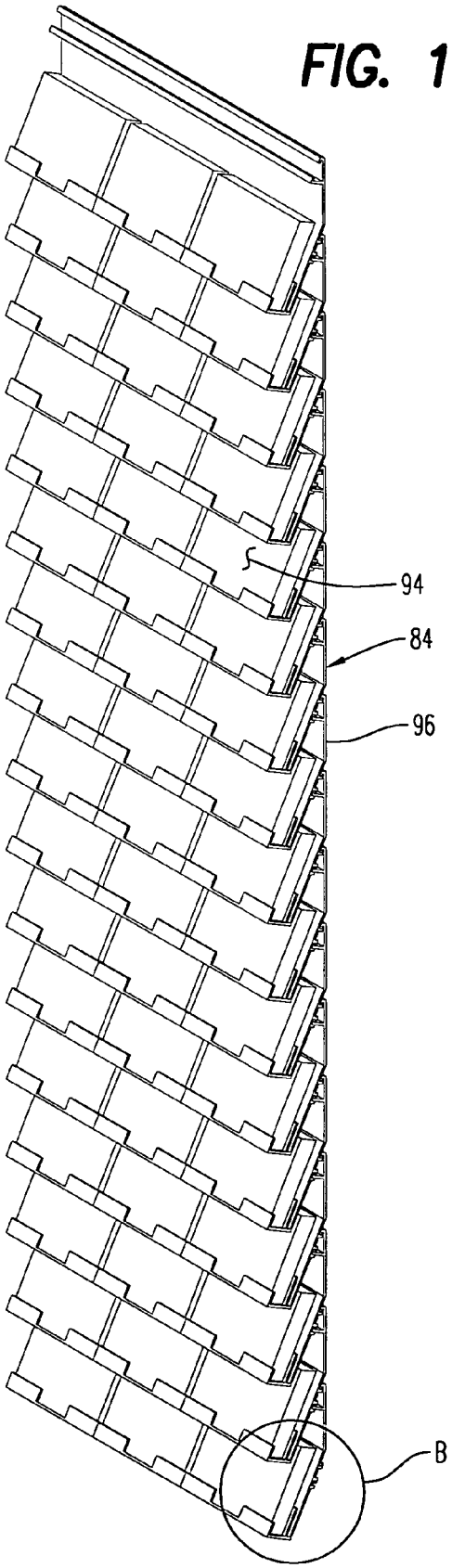
FIG. 11 is a perspective view of one of the modules containing a plurality of columns of pockets which are insertable into the display unit in side-by-side fashion in FIG. 10.
Figure 12:
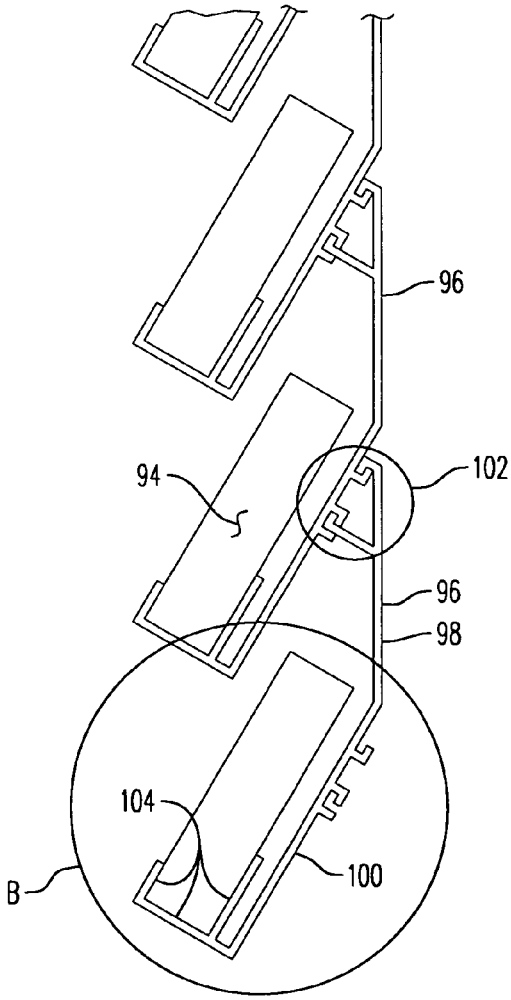
FIG. 12 is an enlarged side elevation view of the lower portion of FIG. 11.

In FIGS. 10 to 12, another embodiment of the combination invention is there shown generally at numeral 80 and includes a display unit 82 and side-by-side modules 84 each forming side-by-side columns of pockets 104 as seen in FIG. 12. The display unit 82 includes upright spaced panels 90 between which each of the columns of modules 84 are positioned and held. Overhead storage at 86 including a plurality of storage bins 88 each of which are closeable by doors supporting enlarged samples of window treatment material (not shown for clarity). Lower storage bins 92 provide additional storage space for extra samples.

In FIGS. 11 and 12, each of the modules 84 include extruded sections having an upright back 96 and a diagonally downwardly extending support panel 100 which lockingly engage together as shown within circle 102. Each group 94 of samples fit snugly into the lower pocket 104 so that the groups of samples 94 lean rearwardly for both visual selection and stability.

Figure 13:
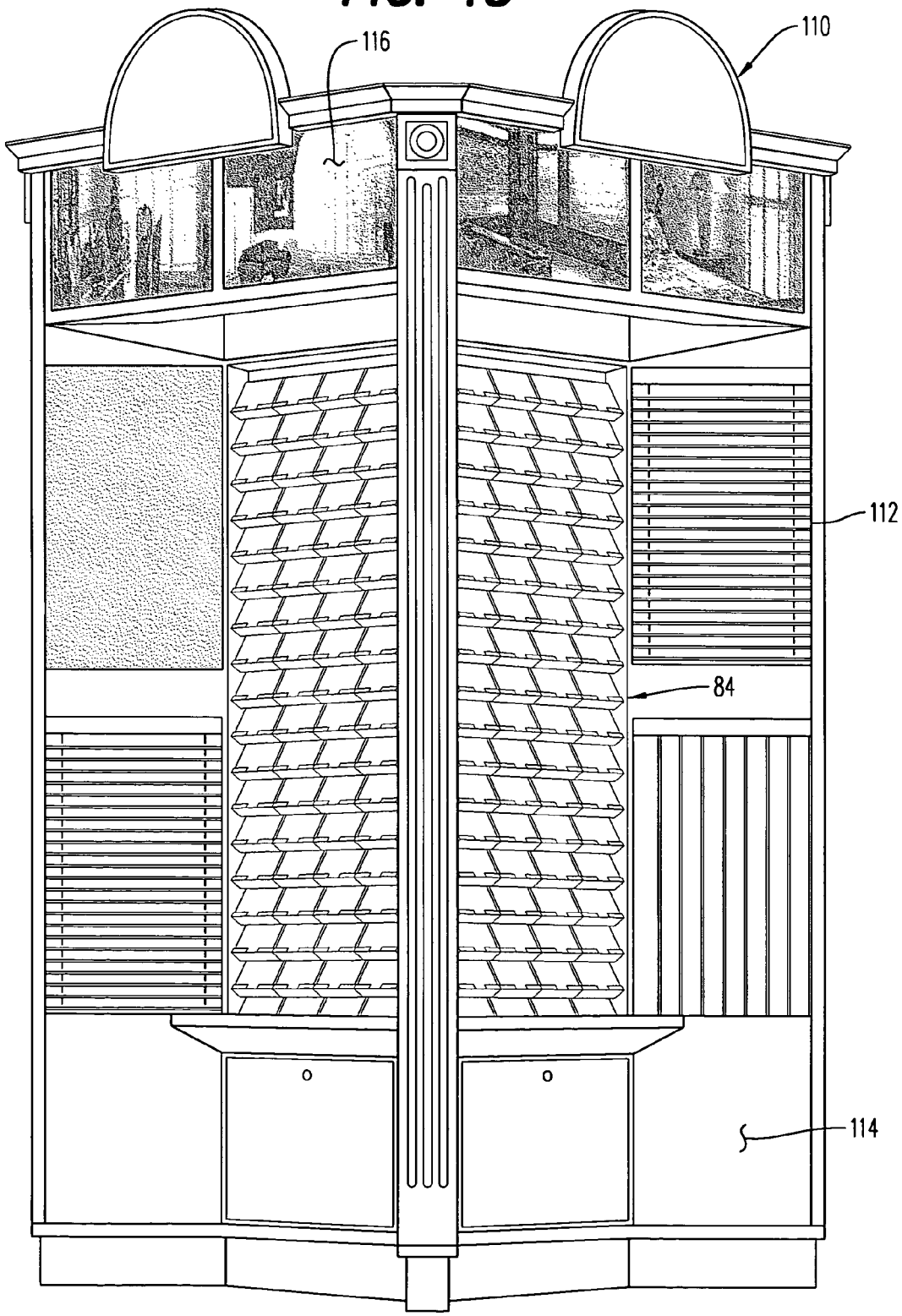
FIG. 13 is a pictorial perspective view of still another embodiment of a display unit including modules of columns of pockets containing groups of window treatment swatch cards held therein.
Figure 14:
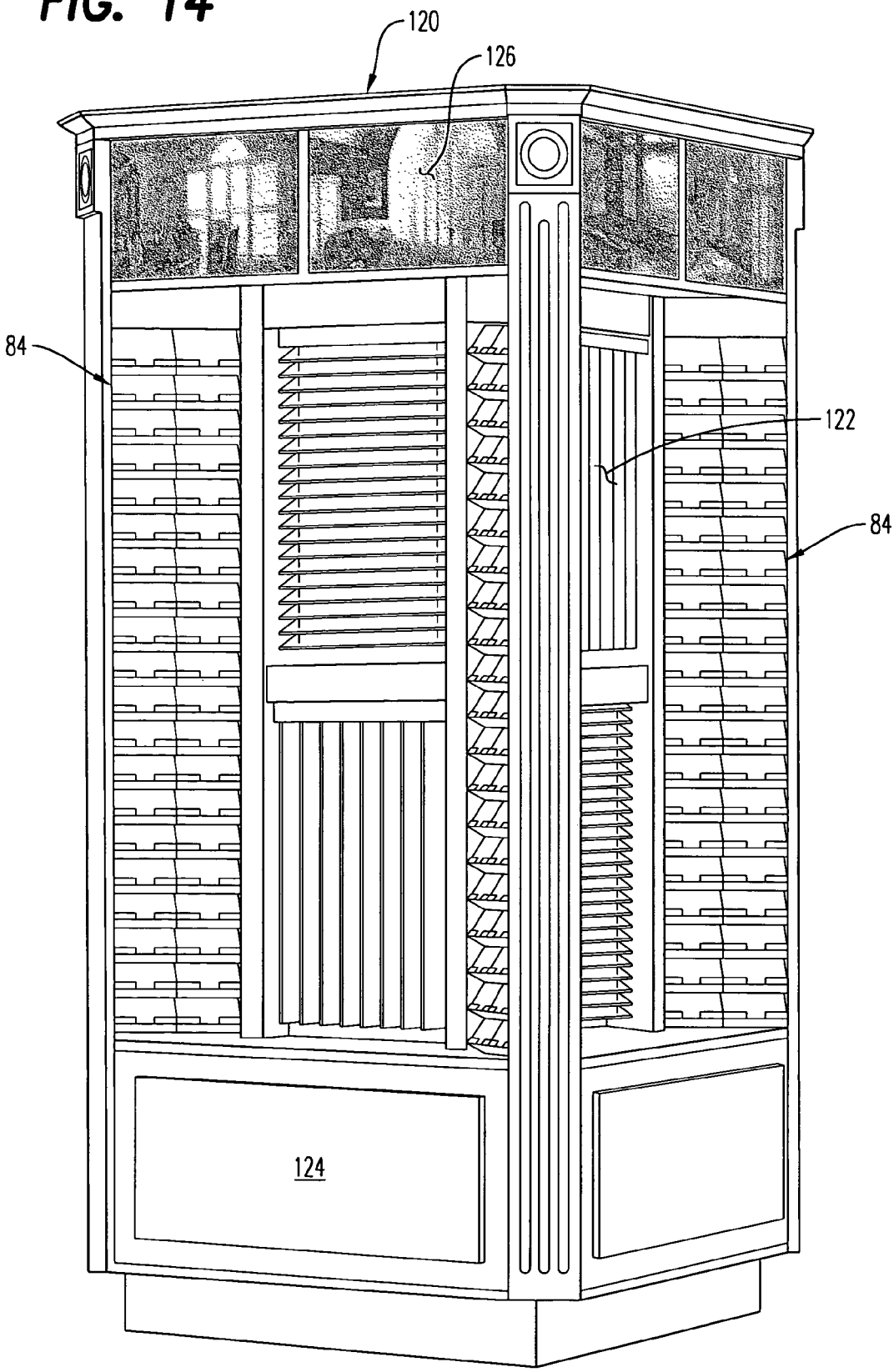
FIG. 14 is still another pictorial perspective view of still another embodiment of a display unit including modules of columns of pockets containing groups of window treatment swatch cards held therein.

Referring now to FIG. 13, still another embodiment of the combination invention is there shown generally at numeral 110 including the display unit 110 and modules 84 each forming side-by-side columns of pockets as previously described in FIG. 12. This display unit 110 further includes panels of sample blinds 112 and lower and upper storage bins 114 and 116, respectively.

Two other embodiments of the invention in the form of the combination display unit and modules 84 are there shown generally at numerals 120 and 130. Each of these embodiments 120 and 130 include sample panels 122 and 134, along with lower and upper storage bins at 124, 126, 132 and behind the sample panel 134.

Lastly, an alternate embodiment of the reverse side of a swatch card 140 is there shown. This reverse surface typically includes pricing of available sizes of each product, information related to both free and surcharge options and other product information.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. In combination, a plurality of groups of individual window treatment swatch cards and a swatch display unit for displaying each of the plurality of groups of said swatch cards, comprising:

each swatch card of each said group having a particular sample of window treatment material and indicia identifying information associated with the particular said sample;

each of said swatch cards within each said group provided with the corresponding particular said sample on a first portion of said swatch card;

each of said swatch cards within each said group provided with said indicia identifying information associated with the corresponding particular said sample on a second portion thereof;

wherein each said sample being configured to be attached on said first portion of said swatch card;

said indicia provided on said second portion of said swatch card;

said display unit including a plurality of upright columns of pockets, each of said pockets being sized for one group of said swatch cards to be removably stored therein in an upright fashion;

said swatch cards having a height greater than that of each said pocket whereby each different said sample of each said group is viewable before being removed from said pocket.

2. A window treatment swatch card unit as set forth in claim 1, wherein:

each said pocket is inclined rearwardly at an angle of about 80° to horizontal.

3. A window treatment swatch card unit as set forth in claim 1, wherein:

said indicia identifying information includes options for sample configuration and vendor identification information.

4. A window treatment swatch card unit as set forth in claim 3, wherein:

each of said samples includes product identification information attached thereon whereby a removed said sample from said swatch card retains product identification information thereon.

5. A window treatment swatch card unit as set forth in claim 1, wherein said display unit further comprises:

enlarged sample display panels which form or cover an openable door providing access into a sample bin.

6. A window treatment swatch card unit as set forth in claim 1, wherein a reverse surface of said swatch card comprises further indicia identification information including standard available sizes, pricing, and available free and surcharge options of the corresponding said sample.

7. A window treatment swatch card unit as set forth in claim 1, wherein:

one said sample is a segment of an expandable cellular shade.

8. A window treatment swatch card unit as set forth in claim 1, wherein:

one said sample is a segment of an arcuate in cross section vertical or horizontal blind.

9. A window treatment swatch card unit as set forth in claim 1, wherein:

one said sample is a segment of woven-together elongated lengths of wood strips.

10. A window treatment swatch card unit for displaying each of a plurality of groups of individual said swatch cards in a swatch display, said swatch card comprising:

each swatch card having a particular sample of window treatment material and indicia identifying information associated with each particular said sample;

each of said swatch cards provided with the corresponding particular said sample on a first portion of said swatch card, each said sample being configured to be attached on said first portion of said swatch card;

each of said swatch cards also provided with said indicia identifying information associated with the corresponding particular said sample on a second portion of said swatch card; said indicia identifying information provided on said second portion of said swatch card;

each swatch card and each group of said swatch cards being adapted in size to be removably stored in one pocket of the display unit which includes a plurality of columns of pockets, whereby each particular sample of each group is held in an upright viewable fashion within one pocket before being removed therefrom.

11. A window treatment swatch card unit as set forth in claim 10, wherein:

each said pocket is inclined rearwardly at an angle of about 80° to horizontal.

12. A window treatment swatch card unit as set forth in claim 10, wherein:

said indicia identifying information includes options for sample configuration and vendor identification information.

13. A window treatment swatch card unit as set forth in claim 12, wherein:

each of said samples includes product identification information attached thereon whereby a removed said sample from said swatch card retains product identification information thereon.

14. A window treatment swatch card unit as set forth in claim 10, wherein said display unit further comprises:

enlarged sample display panels which form or cover an openable door providing access into a sample bin.

15. A window treatment swatch card unit as set forth in claim 10, wherein a reverse surface of said swatch card comprises further indicia identification information including standard available sizes, pricing and available free and surcharge options of the corresponding said sample.

16. A window treatment swatch card unit as set forth in claim 10, wherein:

one said sample is a segment of an expandable cellular shade.

17. A window treatment swatch card unit as set forth in claim 10, wherein:

one said sample is a segment of an arcuate in cross section vertical or horizontal blind.

18. A window treatment swatch card unit as set forth in claim 10, wherein:

one said sample is a segment of woven-together elongated lengths of wood strips.

19. In combination, a plurality of groups of individual window treatment swatch cards and a swatch display unit for displaying each of the plurality of groups of said swatch cards, comprising:

each swatch card of each said group having a particular sample of window treatment material and indicia identifying information associated with the particular said sample;

each of said swatch cards within each said group provided with the corresponding particular said sample on a first portion of said swatch card;

each of said swatch cards within each said group provided with said indicia identifying information associated with the corresponding particular said sample on a second portion thereof;

wherein each said sample is configured to be attached on said first portion of said swatch card;

said indicia provided on said second portion of said swatch card;

said display unit including a plurality of upright modules each including a plurality of columns of pockets, each of said modules being positioned side-by-side in said display unit, each of said pockets being sized for one group of said swatch cards to be removably stored therein in an upright fashion;

said swatch cards having a height greater than that of each said pocket whereby each different said sample of each group of each said group is viewable before being removed from said pocket.

20. A window treatment swatch card unit as set forth in claim 19, wherein:

each said pocket is inclined rearwardly at an angle of about 80° to horizontal.

21. A window treatment swatch card unit as set forth in claim 19, wherein:

said indicia identifying information includes options for sample configuration and vendor identification information.

22. A window treatment swatch card unit as set forth in claim 21, wherein:

each of said samples includes product identification information attached thereon whereby a removed said sample from said swatch card retains product identification information thereon.

23. A window treatment swatch card unit as set forth in claim 19, wherein said display unit further comprises:

enlarged sample display panels which form or cover an openable door providing access into a sample bin.

24. A window treatment swatch card unit as set forth in claim 19, wherein a reverse surface of said swatch card comprises further indicia identification information including standard available sizes, pricing, and available free and surcharge options of the corresponding said sample.

25. A window treatment swatch card unit as set forth in claim 19, wherein:

one said sample is a segment of an expandable cellular shade.

26. A window treatment swatch card unit as set forth in claim 19, wherein:

one said sample is a segment of an arcuate in cross section vertical or horizontal blind.

27. A window treatment swatch card unit as set forth in claim 19, wherein:

one said sample is a segment of woven-together elongated lengths of wood strips.

* * * * *